US009194178B2

(12) United States Patent
Andre de la Porte

(10) Patent No.: US 9,194,178 B2
(45) Date of Patent: Nov. 24, 2015

(54) DOOR FOR INDUSTRIAL BUILDING

(71) Applicant: Peter Charles Andre de la Porte, Grafton, OH (US)

(72) Inventor: Peter Charles Andre de la Porte, Grafton, OH (US)

(73) Assignee: Peter Charles Andre de la Porte, Grafton, OH (US)

( * ) Notice: Subject to any disclaimer, the term of this patent is extended or adjusted under 35 U.S.C. 154(b) by 0 days.

(21) Appl. No.: 14/455,054

(22) Filed: Aug. 8, 2014

(65) Prior Publication Data

US 2015/0041076 A1 Feb. 12, 2015

Related U.S. Application Data

(60) Provisional application No. 61/863,642, filed on Aug. 8, 2013.

(51) Int. Cl.
*E06B 9/58* (2006.01)
*E06B 9/13* (2006.01)

(52) U.S. Cl.
CPC .. *E06B 9/581* (2013.01); *E06B 9/13* (2013.01)

(58) Field of Classification Search
USPC ..... 160/273.1, 242, DIG. 16
IPC ..... E06B 9/581,2009/585
See application file for complete search history.

(56) References Cited

U.S. PATENT DOCUMENTS

| | | | | | |
|---|---|---|---|---|---|
| 4,079,772 | A | * | 3/1978 | Klaenhammer et al. | 160/268.1 |
| 4,175,608 | A | * | 11/1979 | Alten | 160/273.1 |
| 4,419,982 | A | * | 12/1983 | Eckels | 126/625 |
| 4,497,515 | A | * | 2/1985 | Appelson | 296/141 |
| 5,195,594 | A | * | 3/1993 | Allen et al. | 169/48 |
| 5,429,404 | A | * | 7/1995 | King, Sr. | 296/79 |
| 5,850,864 | A | * | 12/1998 | Decker | 160/268.1 |
| 5,896,907 | A | * | 4/1999 | Dever et al. | 160/6 |
| 6,002,332 | A | | 12/1999 | King | |
| 6,359,538 | B1 | | 3/2002 | Jolley et al. | |
| 6,942,001 | B1 | * | 9/2005 | Crider et al. | 160/241 |
| 7,199,688 | B2 | | 4/2007 | Edmonson, Jr. | |
| 7,631,682 | B2 | * | 12/2009 | Lamers et al. | 160/84.06 |
| 7,793,702 | B2 | * | 9/2010 | Biewer et al. | 160/370.22 |
| 8,341,885 | B2 | | 1/2013 | Bostyn | |
| 2013/0087292 | A1 | * | 4/2013 | Gould | 160/89 |

FOREIGN PATENT DOCUMENTS

| | | | |
|---|---|---|---|
| DE | 3743366 | A1 | 7/1989 |
| EP | 0818602 | A1 | 1/1998 |
| EP | 1029557 | A1 | 8/2000 |
| GB | 2306995 | A | 5/1997 |
| WO | 9535427 | A1 | 12/1995 |

OTHER PUBLICATIONS

European Search Report dated Mar. 18, 2015, 5 pages.

* cited by examiner

*Primary Examiner* — David Purol
(74) *Attorney, Agent, or Firm* — Cooper Legal Group LLC

(57) ABSTRACT

A door assembly for covering an opening includes a curtain supported at a first end of the opening. The curtain includes a first lateral edge supporting at least one first curtain magnetic device. The door assembly includes a first track portion extending along a first opening side of the opening between the first end and an opposing second end. The first track portion includes at least one first magnetic assembly. The first curtain magnetic device magnetically couples with the first magnetic assembly of the first track portion such that the curtain is magnetically supported at the first lateral edge of the curtain.

18 Claims, 10 Drawing Sheets

DOOR FOR INDUSTRIAL BUILDING

CROSS-REFERENCE TO RELATED APPLICATIONS

This application claims priority to U.S. Patent Application No. 61/863,642, filed on Aug. 8, 2013, the entire disclosure of which is hereby incorporated by reference.

BACKGROUND

An industrial building may include an opening through which relatively large objects (e.g., equipment, forklifts, etc.) travel through. A door (e.g., curtain) may be installed to be opened and closed, so as to preserve a temperature within the building and/or to reduce unintended passage through the opening.

SUMMARY

Aspects of the present application address the above matters, and others. According to an aspect, a door assembly for covering an opening is provided. The door assembly includes a curtain supported at a first end of the opening. The curtain includes a first lateral edge supporting at least one first curtain magnetic device. The door assembly includes a first track portion extending along a first opening side of the opening between the first end and an opposing second end. The first track portion includes at least one first magnetic assembly. The first curtain magnetic device is configured to magnetically couple with the first magnetic assembly of the first track portion such that the curtain is magnetically supported at the first lateral edge of the curtain.

According to another aspect, a door assembly for covering an opening is provided. The door assembly includes a curtain supported at a first end of the opening. The curtain includes a first lateral edge supporting at least one first curtain magnetic device. The curtain includes a first track portion extending along a first opening side of the opening between the first end and an opposing second end. The first track portion includes a first track wall supporting a first track magnetic device. The first track portion includes a second track wall spaced apart from the first track wall. The second track wall supports a second track magnetic device. The first track portion includes a third track wall attached to the first track wall and the second track wall to define a channel between the first track wall, the second track wall and the third track wall. The first lateral edge of the curtain extends between the first track magnetic device and the second track magnetic device into the channel such that the first curtain magnetic device is magnetically coupled with the first track magnetic device and the second track magnetic device.

According to another embodiment, a door assembly for covering an opening is provided. The door assembly includes a winding assembly positioned at a first end of the opening. The winding assembly includes a shaft and a curtain that is configured to be windably supported on the shaft. The curtain is movable between an unwound position, in which the curtain extends between the first end and an opposing second end of the opening, and a wound position, in which the curtain is windably supported on the shaft. The curtain includes a first lateral edge supporting at least one first curtain magnetic device. The curtain includes a second lateral edge, opposite the first lateral edge, supporting at least one second curtain magnetic device. The door assembly includes a track assembly including a first track portion extending along a first opening side of the opening between the first end and the second end. The first track portion includes at least one first magnetic assembly. The track assembly includes a second track portion extending along a second opening side of the opening between the first end and the second end. The second track portion includes at least one second magnetic assembly. When the curtain is in the unwound position, the first curtain magnetic device is configured to magnetically couple with the first magnetic assembly of the first track portion, the second curtain magnetic device is configured to magnetically couple with the second magnetic assembly of the second track portion such that the curtain is magnetically supported at the first lateral edge and the second lateral edge.

Those of ordinary skill in the art will appreciate still other aspects of the present application upon reading and understanding the appended description.

FIGURES

The application is illustrated by way of example and not limitation in the figures of the accompanying drawings, in which like references indicate similar elements and in which.

DESCRIPTION

Figure 1:
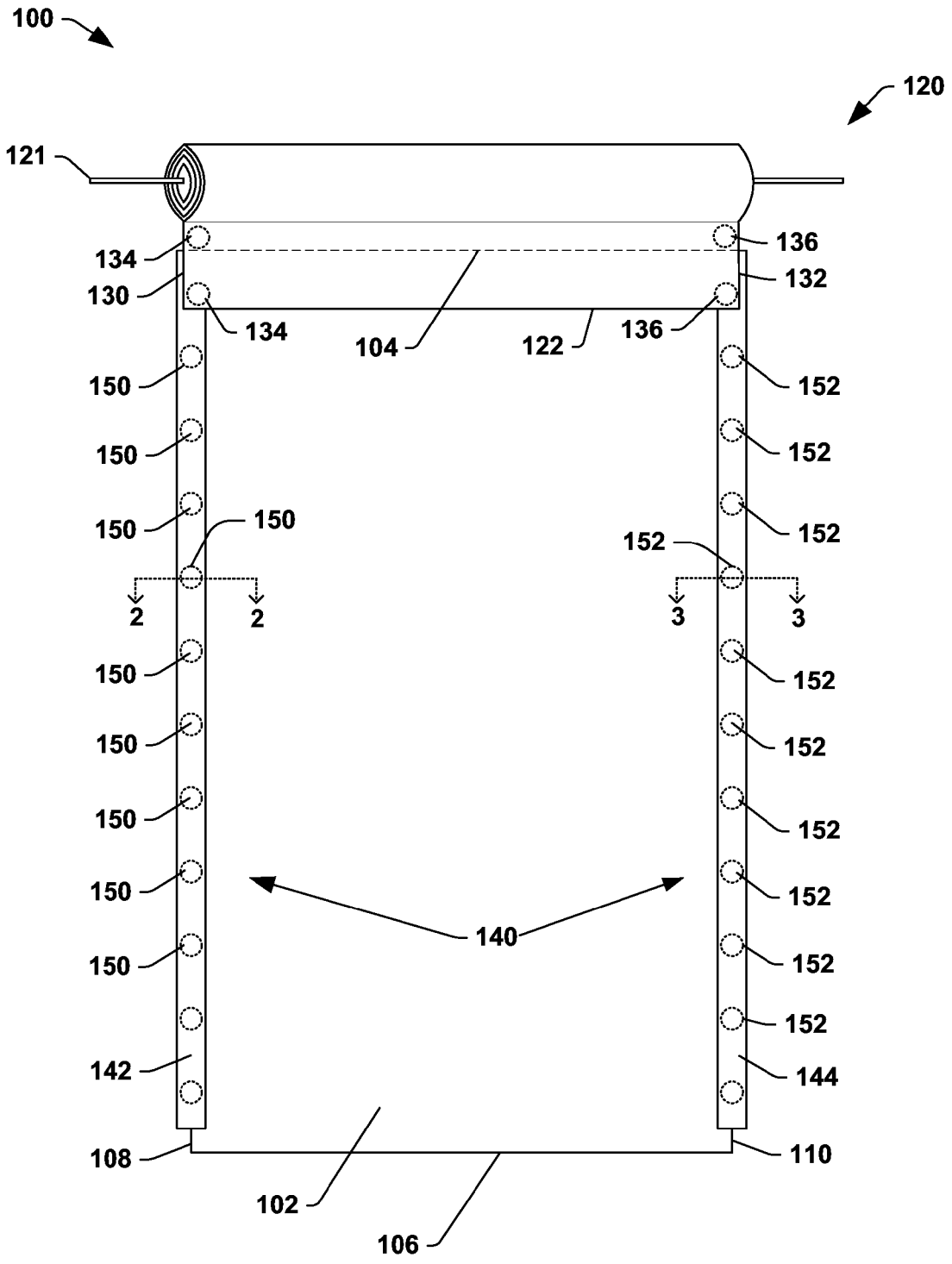
FIG. 1 illustrates an example door assembly associated with an opening.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are illustrated in block diagram form in order to facilitate describing the claimed subject matter.

Turning to FIG. 1, an example door assembly 100 is illustrated. The door assembly 100 can be used in any number of environments, including industrial environments, commercial environments, residential environments, etc. The door assembly 100 can be incorporated as part of a building, house, garage, barn, storage area, or the like. The door assembly 100 can allow for entrance and exit therethrough.

The door assembly 100 can be associated with an opening 102. The opening 102 defines a passageway, space, corridor, etc. through which people and/or objects (e.g., forklifts, equipment, etc.) can pass through. The opening 102 includes a variety of sizes and shapes. In this example, the opening 102 has a rectangular shape. In other examples, however, the opening 102 may include other quadrilateral shapes (e.g., squares, etc.), rounded shapes (e.g., circular shape, oval shape, etc.) or the like. The opening 102 includes any number of dimensions, and, in some examples, may be large enough to accommodate for vehicles, forklifts, etc.

The opening 102 extends between a first end 104 and an opposing second end 106. In this example, the first end 104 can be a top or upper vertical end while the second end 106 can be a bottom or lower vertical end. Such a location of the first end 104 and the second end 106 is not intended to be limiting, however, and in other examples, the first end 104 and/or the second end 106 can include lateral (e.g., vertically extending) sides of the opening 102. In the illustrated example, the opening 102 includes a first opening side 108 and an opposing second opening side 110. The first opening side 108 can extend vertically between the first end 104 and the second end 106. The second opening side 110 can also extend vertically between the first end 104 and the second end 106.

The door assembly 100 can include a winding assembly 120. The winding assembly 120 can include a shaft 121 that rotatably supports a curtain 122 thereon. The winding assembly 120, including the curtain 122, can be supported at the first end 104 of the opening 102. As will be described below, the shaft 121 of the winding assembly 120 can rotate in a first direction and an opposing second direction, such that the curtain 122 can be selectively wound or unwound from the shaft 121. In the illustrated example, the curtain 122 includes a flexible material that has at least some degree of flexibility, pliability, non-rigidity, etc. Indeed, the curtain 122 can be folded, bent, creased, or the like, such that the curtain 122 can be wound onto the winding assembly 120. The curtain 122 includes any number of materials, including metal sheeting, metal, fabric, plastic, screen, mesh, composite materials, or the like. In some examples, stiffeners or other reinforcements can be incorporated into the curtain 122 to provide for at least some degree of rigidity. Additionally, one or more return springs can be incorporated so as to bias the winding assembly 120 towards an unwound position (e.g., illustrated in FIG. 4).

The curtain 122 can extend between a first lateral edge 130 and a second lateral edge 132. In this example, the first lateral edge 130 extends generally vertically and substantially parallel with respect to the first opening side 108 of the opening 102. The second lateral edge 132 extends generally vertically and substantially parallel with respect to the second opening side 110 of the opening 102. The first lateral edge 130 and the second lateral edge 132 define opposing lateral ends of the curtain 122.

The first lateral edge 130 of the curtain 122 can support at least one first curtain magnetic device 134. The first curtain magnetic device 134 can include any number of (e.g., one or more) first curtain magnetic devices 134. In this example, the first curtain magnetic devices 134 can be attached to and/or supported by the curtain 122 in proximity to the first lateral edge 130. The first curtain magnetic devices 134 can be attached to and/or supported by the curtain 122 in any number of ways, such as with adhesives, fasteners, or the like. In some examples, the first curtain magnetic devices 134 extend in a column (e.g., linear axis) along the first lateral edge 130, such that the first curtain magnetic devices 134 are oriented to extend vertically. In other examples, however, the first curtain magnetic devices 134 can be at least partially staggered along the first lateral edge 130.

The second lateral edge 132 of the curtain 122 can support at least one second curtain magnetic device 136. The second curtain magnetic device 136 can include any number of (e.g., one or more) second curtain magnetic devices 136. In this example, the second curtain magnetic devices 136 can be attached to and/or supported by the curtain 122 in proximity to the second lateral edge 132. The second curtain magnetic devices 136 can be attached to and/or supported by the curtain 122 in any number of ways, such as with adhesives, fasteners, or the like. In some examples, the second curtain magnetic devices 136 extend in a column (e.g., linear axis) along the second lateral edge 132, such that the second curtain magnetic devices 136 are oriented to extend vertically. In other examples, however, the second curtain magnetic devices 136 can be at least partially staggered along the second lateral edge 132. In some examples, the first curtain magnetic devices 134 and the second curtain magnetic device 136 are arranged to extend substantially parallel to each other.

The first curtain magnetic devices 134 and the second curtain magnetic devices 136 can generate/produce a magnetic field. In some examples, the first curtain magnetic devices 134 and/or the second curtain magnetic devices 136 include permanent magnets. A permanent magnet includes an object made from a material that is magnetized and creates a magnetic field. In some examples, the first curtain magnetic devices 134 and/or the second curtain magnetic devices 136 include electromagnets. An electromagnet includes a coil of conductive material (e.g., wire) that acts as a magnet (e.g., generates a magnetic field) when an electric current passes through the coil. When the electric current stops and is no longer passed through the coil, the electromagnet no longer acts as a magnet and the magnetic field stops. According to some examples, some or all of the first curtain magnetic devices 134 and the second curtain magnetic devices 136 include permanent magnets, electromagnets, and/or a combination of both permanent magnets and electromagnets.

The door assembly 100 can include a track assembly 140. The track assembly 140 can be used for guiding and/or supporting the curtain 122 in a desired position with respect to the opening 102. For example, the track assembly 140 can guide the curtain 122 as the curtain is lowered from the first end 104 towards the second end 106. The track assembly 140 can ensure that the curtain 122 extends across the opening 102 and is maintained in an extended/spread position across the opening 102 from the first opening side 108 to the second opening side 110. As such, the track assembly 140 can maintain the curtain 122 in the extended/spread position in the event of a force being applied to the curtain 122, such as wind, rain, inadvertent contact, etc.

The track assembly 140 can include a first track portion 142 and a second track portion 144. The first track portion 142 can extend along the first opening side 108 of the opening 102 between the first end 104 and the second end 106. The first track portion 142 can extend substantially vertically (e.g., up/down) from the first end 104 towards the second end 106. In some examples, the first track portion 142 can extend at or past the first end 104 and/or the second end 106. In other examples, however, the first track portion 142 may have a length that is less than a distance separating the first end 104 from the second end 106 (e.g., height of the opening 102).

The first track portion 142 can include at least one first magnetic assembly 150. The first magnetic assembly 150 includes any number of magnetic assemblies (e.g., one or more). The first magnetic assemblies 150 can be attached to and/or supported by the first track portion 142 in any number of ways, such as by adhesives, fasteners, or the like. In an example, the first magnetic assemblies 150 can be arranged to extend substantially vertically along the first track portion 142, such that the first magnetic assemblies 150 extend in a column that is substantially parallel to a column along which the first curtain magnetic devices 134 extend.

The track assembly 140 can include the second track portion 144. The second track portion 144 can extend along the second opening side 110 of the opening 102 between the first end 104 and the second end 106. The second track portion 144 can extend substantially vertically (e.g., up/down) from the first end 104 towards the second end 106. In some examples, the second track portion 144 can extend at or past the first end 104 and/or the second end 106. In other examples, however, the second track portion 144 may have a length that is less than a distance separating the first end 104 from the second end 106 (e.g., height of the opening 102). The second track portion 144 can extend substantially parallel to the first track portion 142.

The second track portion 144 can include at least one second magnetic assembly 152. The second magnetic assembly 152 includes any number of magnetic assemblies (e.g., one or more). The second magnetic assemblies 152 can be attached to and/or supported by the second track portion 144 in any number of ways, such as by adhesives, fasteners, or the like. In an example, the second magnetic assemblies 152 can be arranged to extend substantially vertically along the second track portion 144, such that the second magnetic assemblies 152 extend in a column that is substantially parallel to a column along which the second curtain magnetic devices 136 extend.

The first magnetic assembly 150 and the second magnetic assembly 152 can generate/produce a magnetic field. In some examples, the first magnetic assemblies 150 and/or the second magnetic assemblies 152 include permanent magnets. In some examples, the first magnetic assemblies 150 and/or the second magnetic assemblies 152 include electromagnets. According to some examples, some or all of the first magnetic assemblies 150 and the second magnetic assemblies 152 include permanent magnets, electromagnets, and/or a combination of both permanent magnets and electromagnets.

Figure 2:
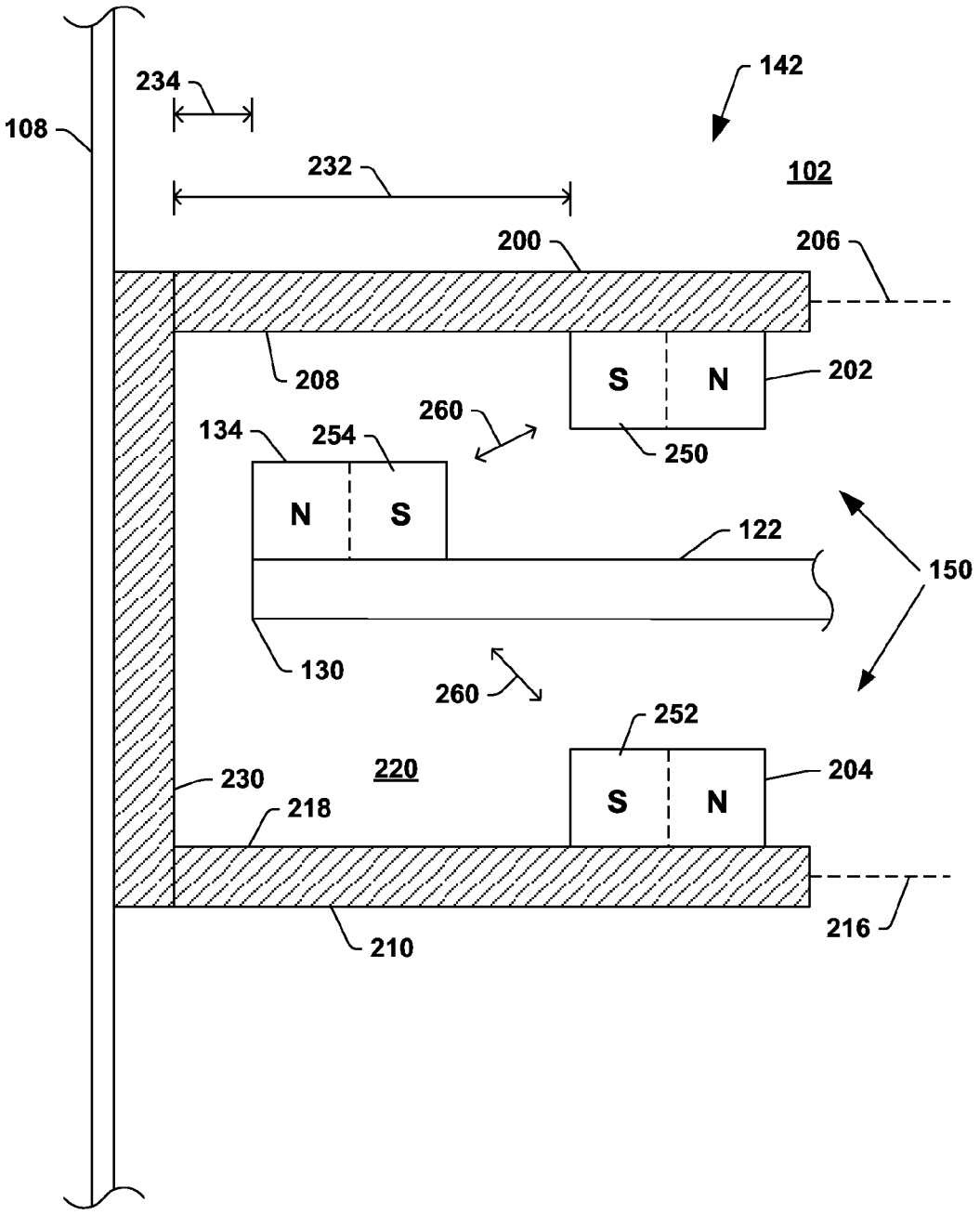
FIG. 2 illustrates a cross-sectional view of an example track portion of the door assembly.

Turning to FIG. 2, a cross-sectional view of the first track portion 142 along lines 2-2 of FIG. 1 is illustrated. The first track portion 142 can include any number of materials that are generally rigid and/or inflexible, including metal materials, plastic materials, composite materials, or the like. The first track portion 142 can be attached to the first opening side 108 of the opening 102. The first track portion 142 can include a first track wall 200. The first track wall 200 can extend in a direction that is substantially perpendicular to the first opening side 108. The first track wall 200 extends outwardly along a first axis 206 from the first opening side 108 towards the curtain 122.

The first magnetic assembly 150 can include a first track magnetic device 202 and a second track magnetic device 204. In this example, the first magnetic assembly 150 is illustrated as including one first track magnetic device 202 and one second track magnetic device 204. In other examples, any number (e.g., one or more) of first track magnetic devices 202 or second track magnetic devices 204 can be provided. Similarly, since the first track portion 142 can support a plurality of first magnetic assemblies 150, the remaining first magnetic assemblies 150 (e.g., illustrated in FIG. 1 above and below section lines 2-2) can be generally identical to the first track magnetic device 202 and the second track magnetic device 204 illustrated in FIG. 2.

The first track wall 200 can support the first track magnetic device 202 of the first magnetic assembly 150. In an example, the first track magnetic device 202 is supported along an inner surface 208 of the first track wall 200. The first track magnetic device 202 can be attached in any number of ways to the first track wall 200, such as with adhesives, fasteners, or the like.

The first track portion 142 can include a second track wall 210. The second track wall 210 can extend in a direction that is substantially perpendicular to the first opening side 108. The second track wall 210 extends outwardly along a second axis 216 from the first opening side 108 towards the curtain 122. The second track wall 210 can support the second track magnetic device 204 of the first magnetic assembly 150. In an example, the second track magnetic device 204 is supported along an inner surface 218 of the second track wall 210. The second track magnetic device 204 can be attached in any number of ways to the second track wall 210, such as with adhesives, fasteners, or the like. In an example, the first axis 206 is substantially parallel to the second axis 216.

The second track wall 210 can be spaced apart a distance from the first track wall 200 to define a channel 220 between the first track wall 200 and the second track wall 210. The first track wall 200 and the second track wall 210 can be spaced at least wide enough to allow for the curtain 122 to pass through the channel 220. In an example, the channel 220 can extend generally vertically along the first opening side 108 between the first end 104 and the second end 106.

The first track portion 142 can include a third track wall 230. The third track wall 230 can extend in a direction that is substantially perpendicular to the first track wall 200 and the second track wall 210. In an example, the third track wall 230 can be attached at a first end to the first track wall 200 and at a second end to the second track wall 210. The third track wall 230 can be attached to the first opening side 108 (e.g., to a wall).

According to some examples, the first track magnetic device 202 and the second track magnetic device 204 can be spaced a first distance 232 from the third track wall 230. In the illustrated example, when the curtain 122 is received within the channel 220, the first curtain magnetic device 134 can be spaced a second distance 234 from the third track wall 230. In this example, the first distance 232 is greater than the second distance 234. That is, the first curtain magnetic device 134 can be positioned in closer proximity to the third track wall 230 (and, thus, the first opening side 108) than the first track magnetic device 202 and the second track magnetic device 204.

In operation, the first axis 206 and the second axis 216 are substantially parallel to the curtain 122 when the curtain 122 extends between the first track magnetic device 202 and the second track magnetic device 204 into the channel 220. In particular, the first lateral edge 130 of the curtain 122 extends between the first track magnetic device 202 and the second track magnetic device 204 into the channel 220.

The first curtain magnetic device 134 can magnetically couple with the first magnetic assembly 150 of the first track portion 142 such that the curtain 122 is magnetically supported at the first lateral edge 130 of the curtain 122. It is to be appreciated that by magnetically coupling, poles of the respective magnets can both be attracted or repelled. For example, as illustrated in FIG. 2, the south pole 250 of the first track magnetic device 202 and the south pole 252 of the second track magnetic device 204 can be oriented to face towards the third track wall 230 and the first opening side 108 while facing away from the opening 102. A south pole 254 of the first curtain magnetic device 134 can face towards the first track magnetic device 202, the second track magnetic device 204 and the opening 102 while facing away from the third track wall 230 and the first opening side 108.

Due to like poles of two or more magnets repelling, a repelling force 260 (illustrated schematically with arrowhead) is exerted between the first curtain magnetic device 134 and the first track magnetic device 202 and the second track magnetic device 204. For example, the first curtain magnetic device 134 is repelled from the first track magnetic device 202 and the second track magnetic device 204. Due to the first track magnetic device 202 and the second track magnetic device 204 being positioned between the first curtain magnetic device 134 and the opening 102, the first curtain magnetic device 134 will tend to remain within the channel 220. As such, inadvertent removal of the curtain 122 from the channel 220 is generally limited.

It will be appreciated that the respective positions of the magnets illustrated in FIG. 2 are not intended to be limiting. Rather, in other examples, the orientations of the first track magnetic device 202, the second track magnetic device 204 and the first curtain magnetic device 134 can be reversed. For example, the north poles of each of the magnets may face each other. Indeed, like poles (e.g., north pole or south pole) of the first track magnetic device 202 and the second track magnetic device 204 can be oriented to face a like pole (e.g., north pole or south pole, respectively) of the first curtain magnetic device 134 to produce the repelling force 260, thus producing the intended magnetic coupling to maintain the curtain 122 within the channel 220.

It will be appreciated that the magnetic coupling described above is not limited to being caused by the repelling force 260. Rather, in another example, like poles (e.g., north pole or south pole) of the first track magnetic device 202 and the second track magnetic device 204 can be oriented to face an opposite pole (e.g., south pole or north pole, respectively) of the first curtain magnetic device 134. In such an example, an attraction force may be produced that attracts the first curtain magnetic device 134 to the first track magnetic device 202 and the second track magnetic device 204. As such, the magnetic coupling (e.g., attraction force in this example) can again allow for the curtain 122 to remain within the channel 220. In these examples, the first curtain magnetic device 134 can magnetically couple (e.g., with the repelling force 260 or the attraction force) with the first magnetic assembly 150 of the first track portion 142 such that the curtain 122 is magnetically supported at the first lateral edge 130 of the curtain 122.

Figure 3:
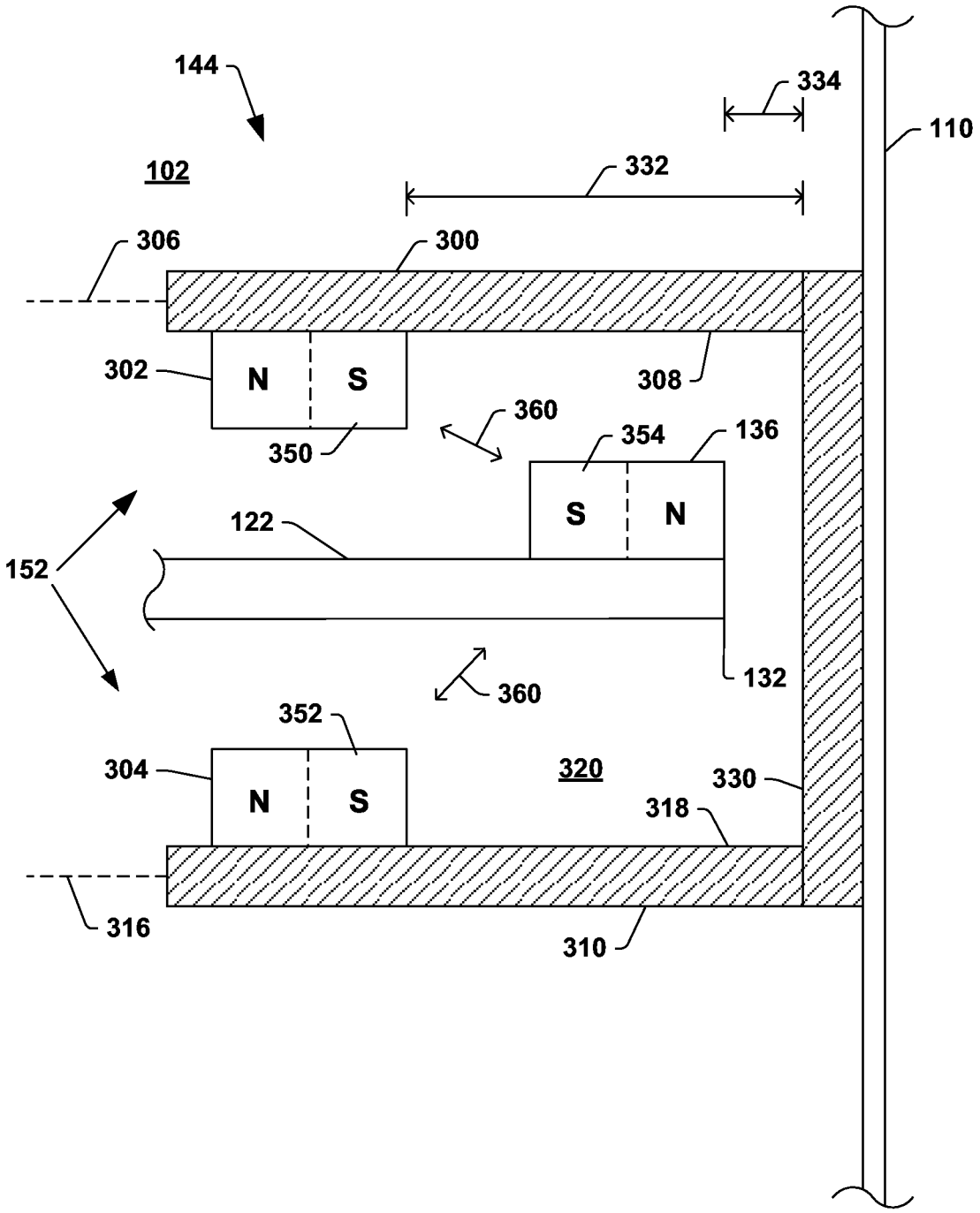
FIG. 3 illustrates a cross-sectional view of an example track portion of the door assembly.

Turning to FIG. 3, a cross-sectional view of the second track portion 144 along lines 3-3 of FIG. 1 is illustrated. The second track portion 144 can be generally similar (e.g., mirror image) to the first track portion 142. The second track portion 144 can include any number of materials that are generally rigid and/or inflexible, including metal materials, plastic materials, composite materials, or the like. The second track portion 144 can be attached to the second opening side 110 of the opening 102. The second track portion 144 can include a first track wall 300. The first track wall 300 can extend in a direction that is substantially perpendicular to the second opening side 110. The first track wall 300 extends outwardly along a first axis 306 from the second opening side 110 towards the curtain 122.

The second magnetic assembly 152 can include a first track magnetic device 302 and a second track magnetic device 304. In this example, the second magnetic assembly 152 is illustrated as including one first track magnetic device 302 and one second track magnetic device 304. In other examples, any number (e.g., one or more) of first track magnetic devices 302 or second track magnetic devices 304 can be provided. Similarly, since the second track portion 144 can support a plurality of second magnetic assemblies 152, the remaining second magnetic assemblies 152 (e.g., illustrated in FIG. 1 above and below section lines 3-3) can be generally identical to the first track magnetic device 302 and the second track magnetic device 304 illustrated in FIG. 3.

The first track wall 300 can support the first track magnetic device 302 of the second magnetic assembly 152. In an example, the first track magnetic device 302 is supported along an inner surface 308 of the first track wall 300. The first track magnetic device 302 can be attached in any number of ways to the first track wall 300, such as with adhesives, fasteners, or the like.

The second track portion 144 can include a second track wall 310. The second track wall 310 can extend in a direction that is substantially perpendicular to the second opening side 110. The second track wall 310 extends outwardly along a second axis 316 from the second opening side 110 towards the curtain 122. The second track wall 310 can support the second track magnetic device 304 of the second magnetic assembly 152. In an example, the second track magnetic device 304 is supported along an inner surface 318 of the second track wall 310. The second track magnetic device 304 can be attached in any number of ways to the second track wall 310, such as with adhesives, fasteners, or the like. In an example, the first axis 306 is substantially parallel to the second axis 316.

The second track wall 310 can be spaced apart a distance from the first track wall 300 to define a channel 320 between the first track wall 300 and the second track wall 310. The first track wall 300 and the second track wall 310 can be spaced at least wide enough to allow for the curtain 122 to pass through the channel 320. In an example, the channel 320 can extend generally vertically along the second opening side 110 between the first end 104 and the second end 106.

The second track portion 144 can include a third track wall 330. The third track wall 330 can extend in a direction that is substantially perpendicular to the first track wall 300 and the second track wall 310. In an example, the third track wall 330 can be attached at a first end to the first track wall 300 and at a second end to the second track wall 310. The third track wall 330 can be attached to the second opening side 110 (e.g., to a wall).

According to some examples, the first track magnetic device 302 and the second track magnetic device 304 can be spaced a first distance 332 from the third track wall 330. In the illustrated example, when the curtain 122 is received within the channel 320, the second curtain magnetic device 136 can be spaced a second distance 334 from the third track wall 330. In this example, the first distance 332 is greater than the second distance 334. That is, the second curtain magnetic device 136 can be positioned in closer proximity to the third track wall 330 (and, thus, the second opening side 110) than the first track magnetic device 302 and the second track magnetic device 304.

In operation, the first axis 306 and the second axis 316 are substantially parallel to the curtain 122 when the curtain 122 extends between the first track magnetic device 302 and the second track magnetic device 304 into the channel 320. In particular, the second lateral edge 132 of the curtain 122 extends between the first track magnetic device 302 and the second track magnetic device 304 into the channel 320.

The second curtain magnetic device 136 can magnetically couple with the second magnetic assembly 152 of the second track portion 144 such that the curtain 122 is magnetically supported at the second lateral edge 132 of the curtain 122. It is to be appreciated that by magnetically coupling, poles of the respective magnets can both be attracted or repelled. For example, as illustrated in FIG. 3, the south pole 350 of the first track magnetic device 302 and the south pole 352 of the second track magnetic device 304 can be oriented to face towards the third track wall 330 and the second opening side 110 while facing away from the opening 102. A south pole 354 of the second curtain magnetic device 136 can face towards the first track magnetic device 302, the second track magnetic device 304 and the opening 102 while facing away from the third track wall 330 and the second opening side 110.

Due to like poles of two or more magnets repelling, a repelling force 360 (illustrated schematically with arrowhead) is exerted between the second curtain magnetic device 136 and the first track magnetic device 302 and the second track magnetic device 304. For example, the second curtain magnetic device 136 is repelled from the first track magnetic device 302 and the second track magnetic device 304. Due to the first track magnetic device 302 and the second track magnetic device 304 being positioned between the second curtain magnetic device 136 and the opening 102, the second curtain magnetic device 136 will tend to remain within the channel 320. As such, inadvertent removal of the curtain 122 from the channel 220 is generally limited.

It will be appreciated that the respective positions of the magnets illustrated in FIG. 3 are not intended to be limiting. Rather, in other examples, the orientations of the first track magnetic device 302, the second track magnetic device 304 and the second curtain magnetic device 136 can be reversed. For example, the north poles of each of the magnets may face each other. Indeed, like poles (e.g., north pole or south pole) of the first track magnetic device 302 and the second track magnetic device 304 can be oriented to face a like pole (e.g., north pole or south pole, respectively) of the second curtain magnetic device 136 to produce the repelling force 360, thus producing the intended magnetic coupling to maintain the curtain 122 within the channel 220.

It will be appreciated that the magnetic coupling described above is not limited to being caused by the repelling force 360. Rather, in another example, like poles (e.g., north pole or south pole) of the first track magnetic device 302 and the second track magnetic device 304 can be oriented to face an opposite pole (e.g., south pole or north pole, respectively) of the second curtain magnetic device 136. In such an example, an attraction force may be produced that attracts the second curtain magnetic device 136 to the first track magnetic device 302 and the second track magnetic device 304. As such, the magnetic coupling (e.g., attraction force in this example) can again allow for the curtain 122 to remain within the channel 220. In these examples, the second curtain magnetic device 136 can magnetically couple (e.g., with the repelling force 360 or the attraction force) with the second magnetic assembly 152 of the second track portion 144 such that the curtain 122 is magnetically supported at the second lateral edge 132 of the curtain 122.

Figure 4:
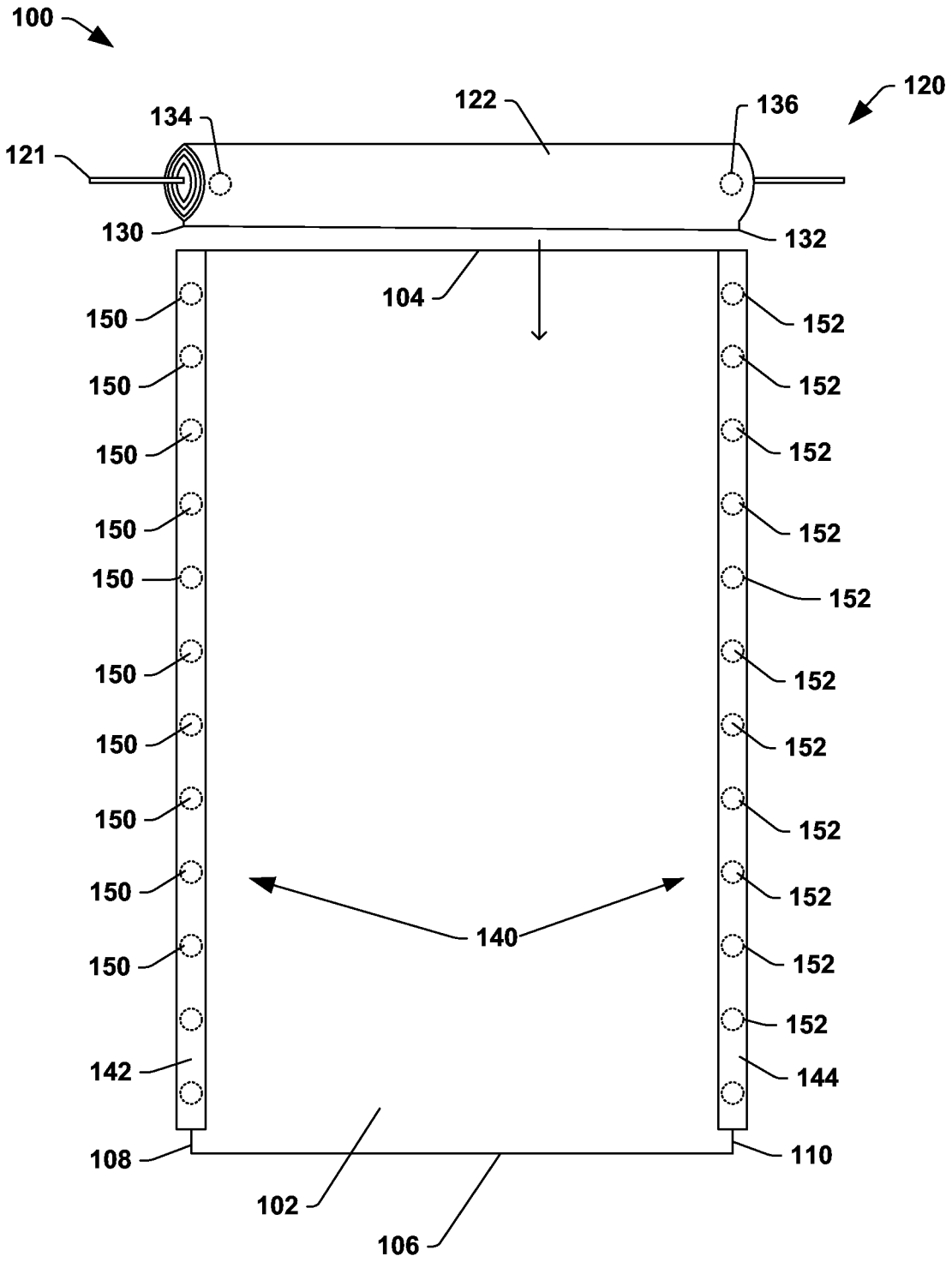
FIG. 4 illustrates an example curtain for the door assembly in a wound position.

Turning to FIG. 4, the curtain 122 of the winding assembly 120 is illustrated in a wound position. In the wound position, the curtain 122 can be fully or near fully wound onto the shaft 121. In the wound position, the curtain 122 is wound onto the shaft 121 and positioned at the first end 104 of the opening 102. As such, in the wound position, the opening 102 is generally open/exposed and the curtain 122 may not block or cover the opening 102.

Figure 5:
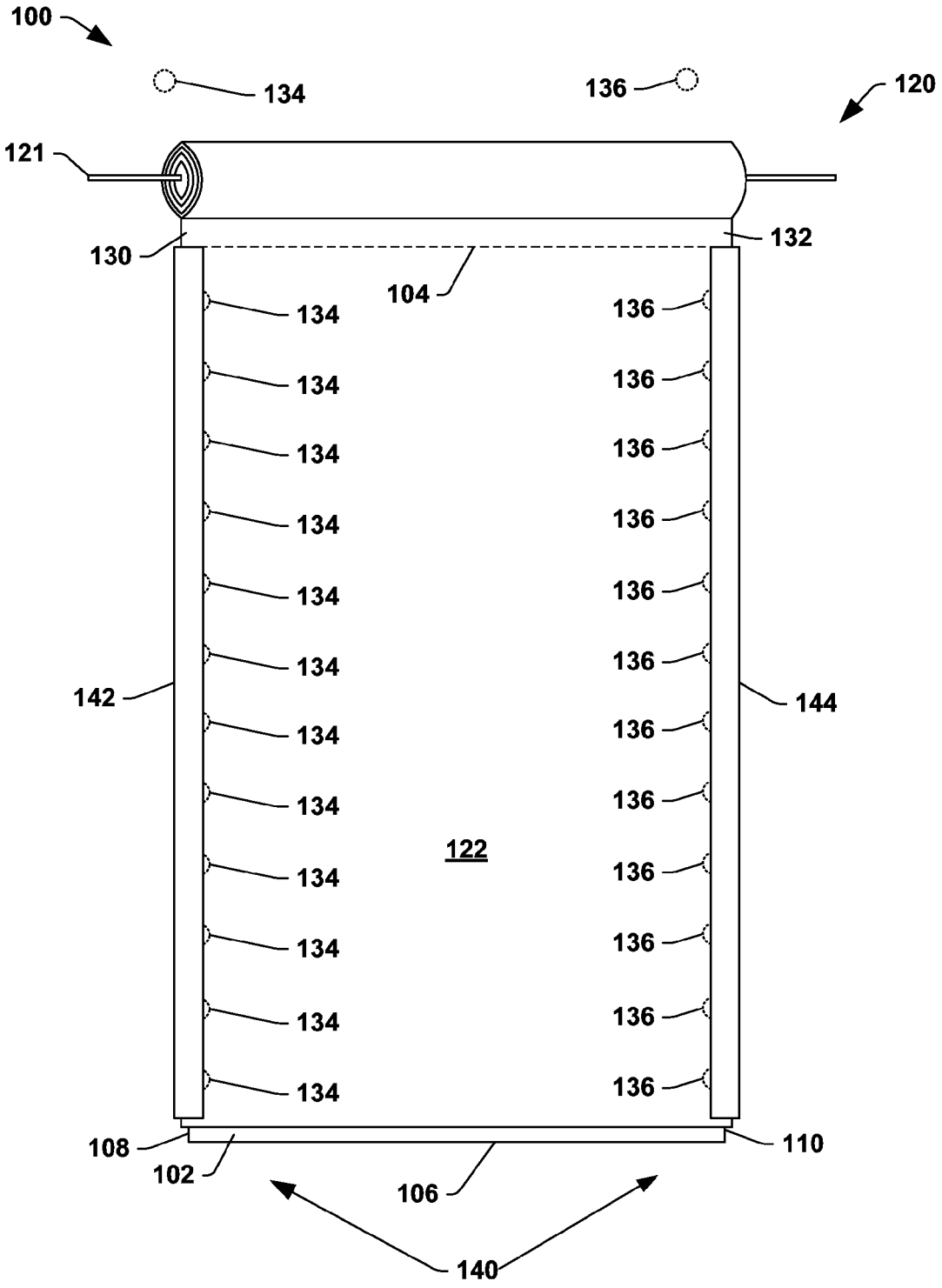
FIG. 5 illustrates an example curtain for the door assembly in an unwound position.

Turning to FIG. 5, the curtain 122 of the winding assembly 120 is illustrated in an unwound position. To move between the wound position and the unwound position, the shaft 121 can be rotated in a first direction or a second direction. From the wound position, rotation of the shaft 121 can cause the curtain 122 to unwind and move from the first end 104 towards the second end 106, thus covering the opening 102. Conversely, from the unwound position, rotation of the shaft 121 in an opposite direction can cause the curtain 122 to wind and move from the second end 106 towards the first end 104, thus exposing the opening 102. In the unwound position, the first lateral edge 130 of the curtain 122 can be supported within the first track portion 142. Similarly, in the unwound position, the second lateral edge 132 of the curtain 122 can be supported within the second track portion 144.

Figure 6:
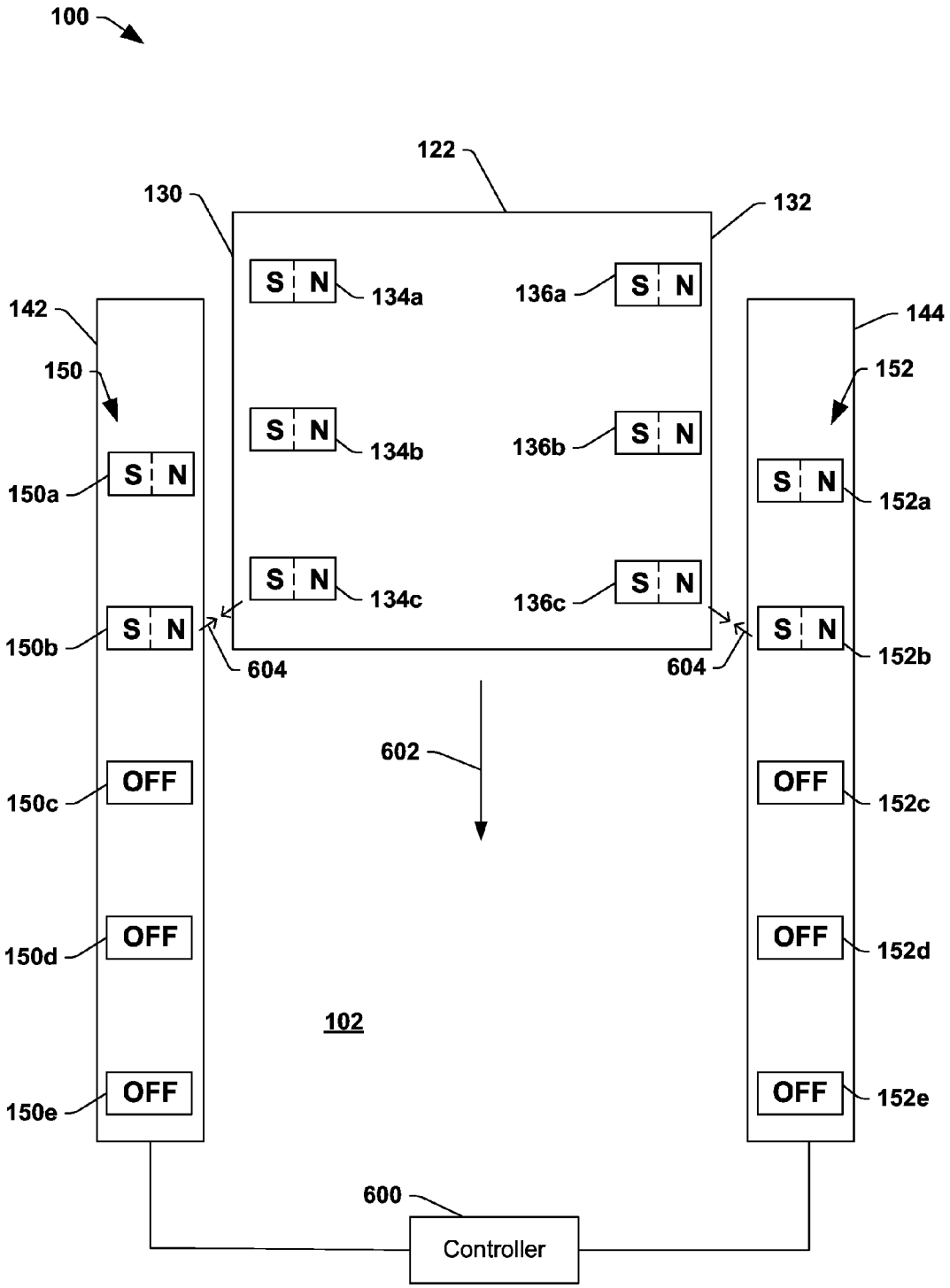
FIG. 6 illustrates movement of an example curtain for the door assembly.

Turning to FIG. 6, an example operation of the door assembly 100 is illustrated. In this example, the curtain 122, including the first magnetic devices 134*a*-134*c* along the first lateral edge 130, can engage the first magnetic assemblies 150 and the second magnetic assemblies 152. It will be appreciated that, for ease of illustration and understanding, the winding assembly 120, the track assembly 140, etc. are not illustrated. In operation, however, the description pertaining to FIG. 6 can be incorporated and/or used with the structures illustrated in FIG. 1.

The door assembly 100 can include one or more controllers 600 that can be electrically connected to the first magnetic assemblies 150 and/or the second magnetic assemblies 152. The controller 600 can include a circuit that is electrically connected to a current supply source and electrically connected, via switch elements, to a plurality of electromagnets 150*a*-150*e* and 152*a*-152*e*. Using the same circuit for the plurality of electromagnets 150*a*-150*e* and 152*a*-152*e* can facilitate coordination of energization and, thus curtain 122 operation. However, in other examples, the controller 600 can include different circuitry for different tracks, rows, and/or different electromagnets 150*a*-150*e* and 152*a*-152*e* if there is appropriate synchronization between or among such circuitry.

In this example, the first magnetic assemblies 150 and the second magnetic assemblies 152 include the plurality of electromagnets 150*a*-150*e* and 152*a*-152*e*. In an example, the controller 600 can provide current to the first magnetic assemblies 150 (e.g., to first electromagnets 150*a* to 150*e*) and the second magnetic assemblies 152 (e.g., to second electromagnets 152*a* to 152*e*). By providing current, the controller 600 can selectively energize at least some (e.g., one or more) of the first electromagnets 150*a*-150*e* of the first magnetic assemblies 150 and at least some (e.g., one or more) of the second electromagnets 152*a*-152*e*. By selectively energizing the electromagnets, the controller 600 can induce an electromagnetic field in the electromagnets that are selectively energized. In an example, the controller 600 can energize at least some of the electromagnets 150*a*-150*e*, 152*a*-152*e* in a forward direction and a reverse direction.

In the illustrated example, of FIG. 6, the first magnetic assemblies 150 (e.g., to first electromagnets 150*a* to 150*e*) and the second magnetic assemblies 152 (e.g., to second electromagnets 152*a* to 152*e*) can induce the curtain 122 to move in a downward direction 602. For example, a second electromagnet 150*b* of the first magnetic assembly 150 can be energized by the controller 600. In such an example, the controller 600 may not energize the other electromagnets 150*c*, 150*d*, 150*e* of the first magnetic assembly 150, such that these electromagnets 150*c*, 150*d*, 150*e* remain off and do not generate a magnetic field. In this example, a second electromagnet 152*b* of the second magnetic assembly 152 can be energized by the controller 600. In such an example, the controller 600 may not energize the other electromagnets 152*c*, 152*d*, 152*e* of the second magnetic assembly 152, such that these electromagnets 152*c*, 152*d*, 152*e* remain off and do not generate a magnetic field.

The selectively energized electromagnets, which include the second electromagnet 150*b* of the first magnetic assembly 150 and the second electromagnet 152*b* of the second magnetic assembly 152 in this example, can magnetically couple 604 (e.g., illustrated with attraction lines) with the at least one first curtain magnetic device 134*c* and with the at least one second curtain magnetic device 136*c*, respectively. As such, since the first curtain magnetic device 134*c* and the second curtain magnetic device 136*c* are located higher than the second electromagnets 150*b*, 152*b*, the magnetic coupling 604 can move the curtain 122 in the downward direction 602 along the first track portion 142 and the second track portion 144.

It will be appreciated that while the second electromagnets 150*b*, 152*b* are illustrated as magnetically coupling 604 with the first curtain magnetic device 134*c* and the second curtain magnetic device 136*c*, such an example of magnetic coupling 604 is not intended to be limiting. Rather, in another example, the magnetic coupling 604 can occur between the second electromagnet 150*b* and more than one first curtain magnetic device, such as by magnetically coupling 604 with two first curtain magnetic devices 134*b*, 134*c*. Similarly, the magnetic coupling 604 can occur between the second electromagnet 152*b* and more than one second curtain magnetic device, such as by magnetically coupling 604 with two second curtain magnetic devices 136*b*, 136*c*. In either of these examples, the curtain 122 can be moved in the downward direction 602.

To increase the magnetic coupling between the curtain 122 and both the first track portion 142 and the second track portion 144, the first electromagnets 150*a* and 152*b* can also be selectively energized by the controller 160. In such an example, the first electromagnets 150*a* and 152*b* can magnetically couple (e.g., magnetic coupling 604) with the first curtain magnetic device 134*b* and the second curtain magnetic device 136*b*. As such, the curtain 122 may be more likely to remain magnetically coupled with the first track portion 142 and the second track portion 144, such that inadvertent detachment of the curtain 122 from the first track portion 142 and the second track portion 144 is limited.

Figure 7:
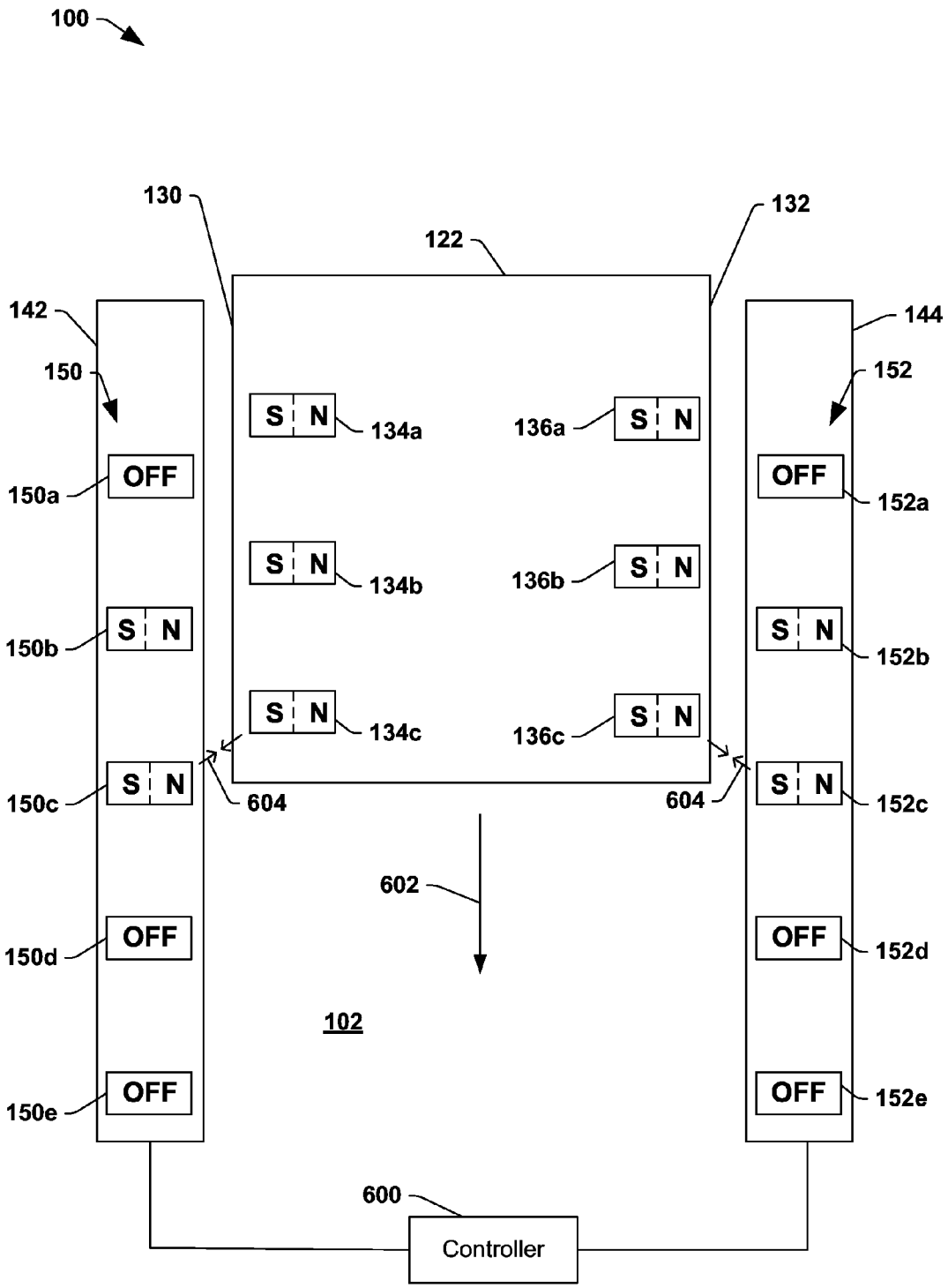
FIG. 7 illustrates movement of an example curtain for the door assembly.

Turning to FIG. 7, to continue movement of the curtain 122 in the downward direction 602, the controller 600 can energize the next lower electromagnets (e.g., third electromagnets 150*c*, 152*c*) that are below the second electromagnets 150*b*, 152*b*. As described above with respect to FIG. 6, the magnetic coupling 604 can again occur, this time between the third electromagnet 150*c* and the first curtain magnetic device 134*c*. The magnetic coupling 604 can also occur between the third electromagnet 152*c* and the second curtain magnetic device 136*c*. Likewise, to increase the magnetic coupling between the curtain 122 and both the first track portion 142 and the second track portion 144, the second electromagnets 150*b* and 152*b* can also be selectively energized by the controller 160 so as to magnetically couple with the first curtain magnetic device 134*b* and the second curtain magnetic device 136*b*. Though not illustrated in FIG. 7, the first electromagnets 150*a* and 152*a* can likewise be selectively energized to facilitate magnetic coupling and, thus, limit inadvertent detachment of the curtain 122.

Figure 8:
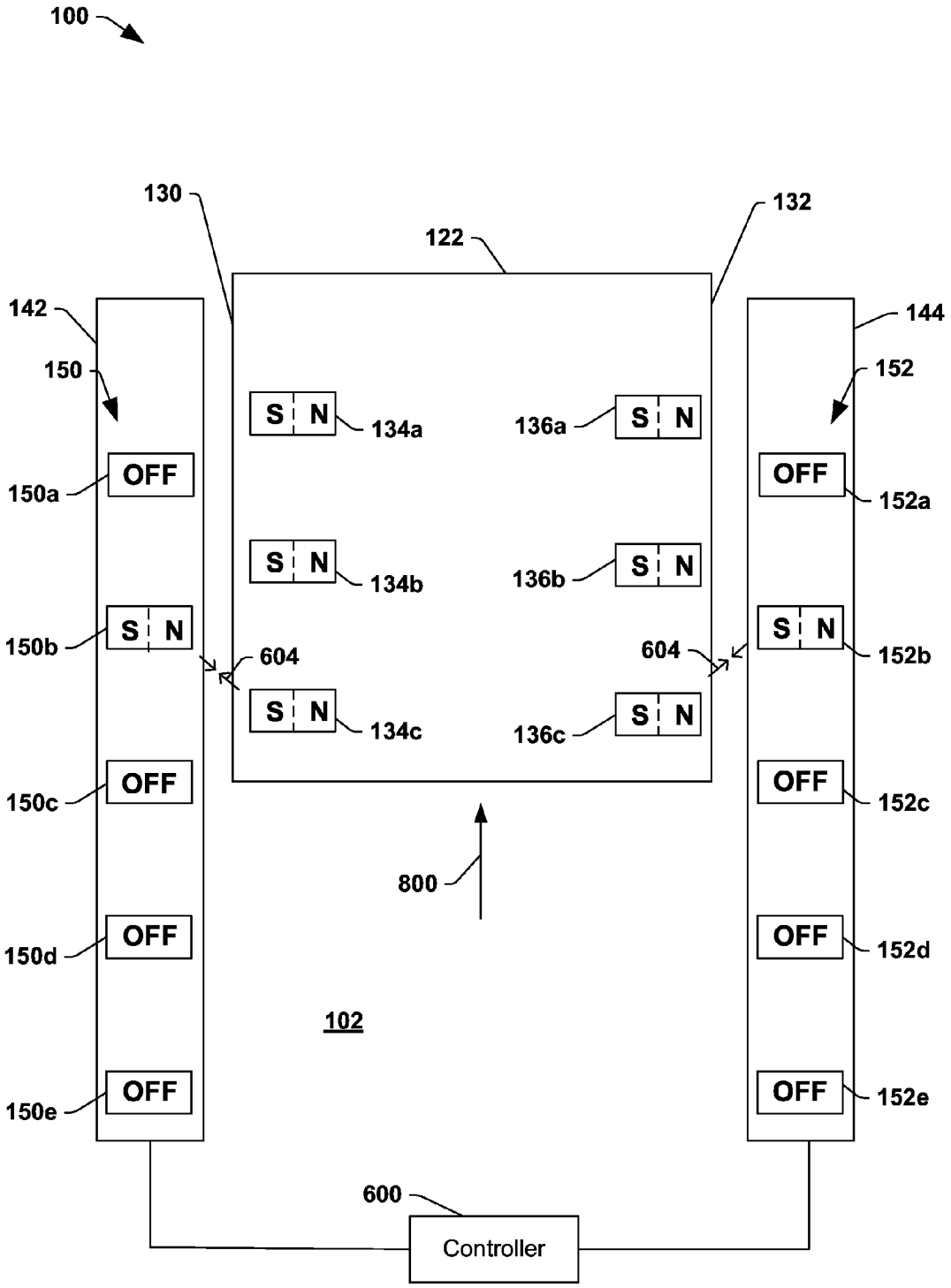
FIG. 8 illustrates movement of an example curtain for the door assembly.

Turning to FIG. 8, the controller 600 can selectively energize at least some of the electromagnets 150*a*-150*e*, 152*a*-152*e* to induce the curtain 122 to move in an upward direction 800. For example, one or more electromagnets 150*a*-150*e* of the first magnetic assembly 150 and/or one or more electromagnets 152*a*-152*e* of the second magnetic assembly 152 can be selectively energized by the controller 600 that are located above one of the first magnetic devices 134*a*-134*c* and/or above the second magnetic devices 136*a*-136*c*. In the illustrated example, the second electromagnet 150*b* of the first magnetic assembly 150 can be energized by the controller 600. In such an example, the controller 600 may not energize the other electromagnets 150*a*, 150*c*, 150*d*, 150*e* of the first magnetic assembly 150, such that these electromagnets 150*a*, 150*c*, 150*d*, 150*e* remain off and do not generate a magnetic field. In this example, a second electromagnet 152*b* of the second magnetic assembly 152 can be energized by the controller 600. In such an example, the controller 600 may not energize the other electromagnets 152*a*, 152*c*, 152*d*, 152*e* of the second magnetic assembly 152, such that these electromagnets 152*a*, 152*c*, 152*d*, 152*e* remain off and do not generate a magnetic field.

The selectively energized electromagnets, which include the second electromagnet 150*b* of the first magnetic assembly 150 and the second electromagnet 152*b* of the second magnetic assembly 152 in this example, can magnetically couple 604 (e.g., illustrated with attraction lines) with the at least one first curtain magnetic device 134*c* and with the at least one second curtain magnetic device 136*c*, respectively. As such, since the first curtain magnetic device 134*c* and the second curtain magnetic device 136*c* are located lower than the second electromagnets 150*b*, 152*b*, the magnetic coupling 604 can move the curtain 122 in the upward direction 800 along the first track portion 142 and the second track portion 144.

By selectively energizing the electromagnets 150*a*-150*e* and 152*a*-152*e*, the controller 600 can cause the curtain 122 to move in the downward direction 602 and/or the upward direction 800. In an example, the controller 600 can cause the curtain 122 to move between the wound position (e.g., illustrated in FIG. 4) and the unwound position (e.g., illustrated in FIG. 5).

Figure 9:
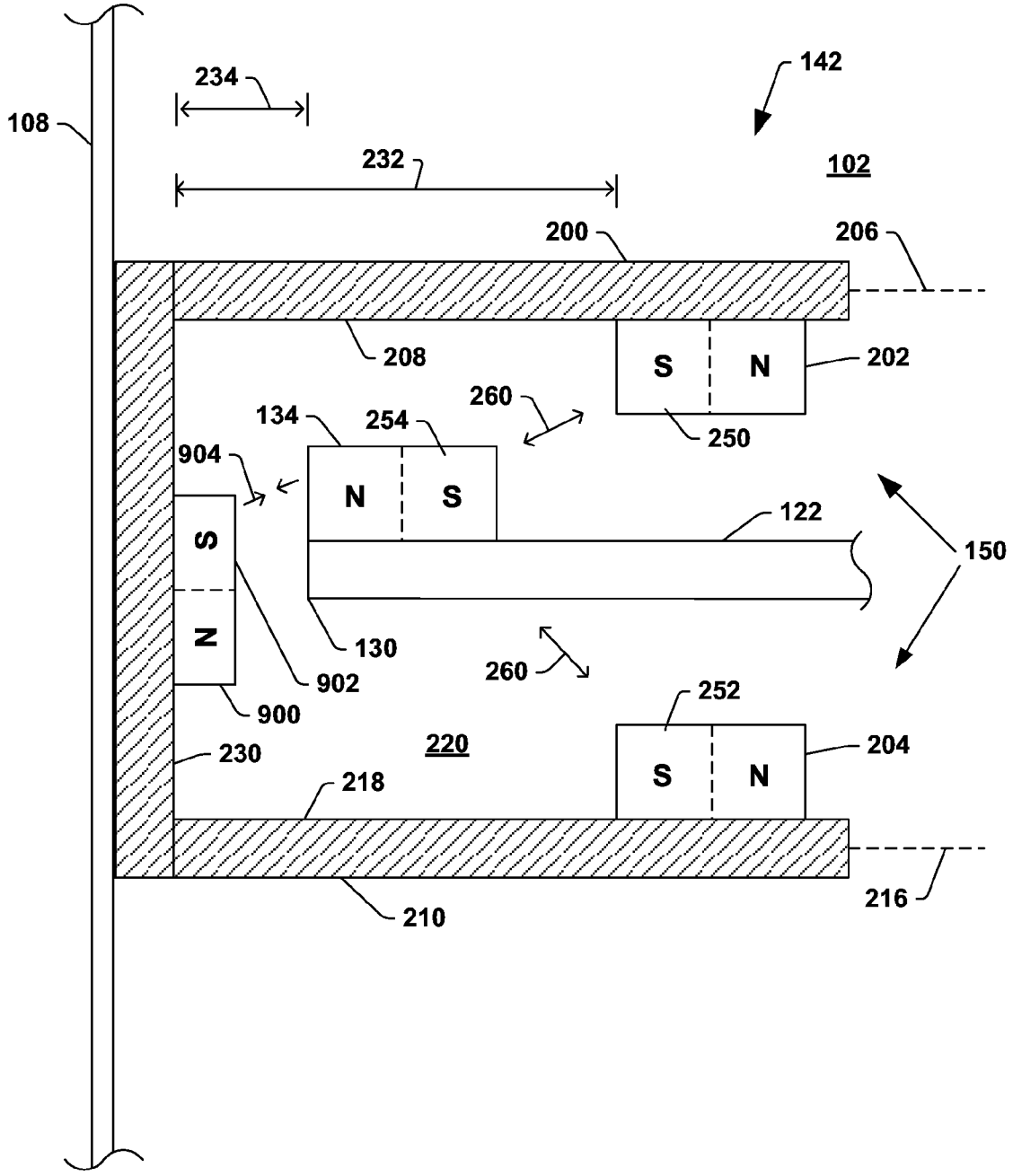
FIG. 9 illustrates a cross-sectional view of an example track portion of the door assembly.

Turning to FIG. 9, a second example of the first track portion 142 is illustrated. In this example, one or more of the first magnetic assemblies 150 can include a third track magnetic device 900 as part of the first track portion 142. In this example, a south pole 902 of the third track magnetic device 900 can be positioned in proximity and facing a north pole of the first curtain magnetic device 134. It will be appreciated that the third track magnetic device 900 is not limited to including the south pole 902 facing the first curtain magnetic device 134. Rather, in other examples, opposite poles of the first curtain magnetic device 134 and the third track magnetic device 900 can be positioned to face each other. Indeed, in another possible example, a north pole of the third track magnetic device 900 can be positioned in proximity and facing a south pole of the first curtain magnetic device 134, such that a position of the first curtain magnetic device 134 can be inverted from the embodiment illustrated in FIG. 9 and a position of the third track magnetic device 900 can be inverted from the embodiment illustrated in FIG. 9.

It will be appreciated that the third track magnetic device 900 is not limited to being located within the first track portion 142 as part of one or more of the first magnetic assemblies 150. Rather, in another example, the third track magnetic device 900 can be included as part of one or more of the second magnetic assemblies 152. In such an example, the third track magnetic device 900 can be attached to the second track portion 144, such as by being attached to the third track wall 330. The third track magnetic device 900 can be oriented with respect to the second curtain magnetic device 136 in a similar manner as described with respect to the first curtain magnetic device 134. Accordingly, in the above examples, the third track magnetic device 900 can magnetically couple 904 with the first curtain magnetic device 134 and/or the second curtain magnetic device 136, so as to limit inadvertent removal of the curtain 122 from the channel(s).

Figure 10:
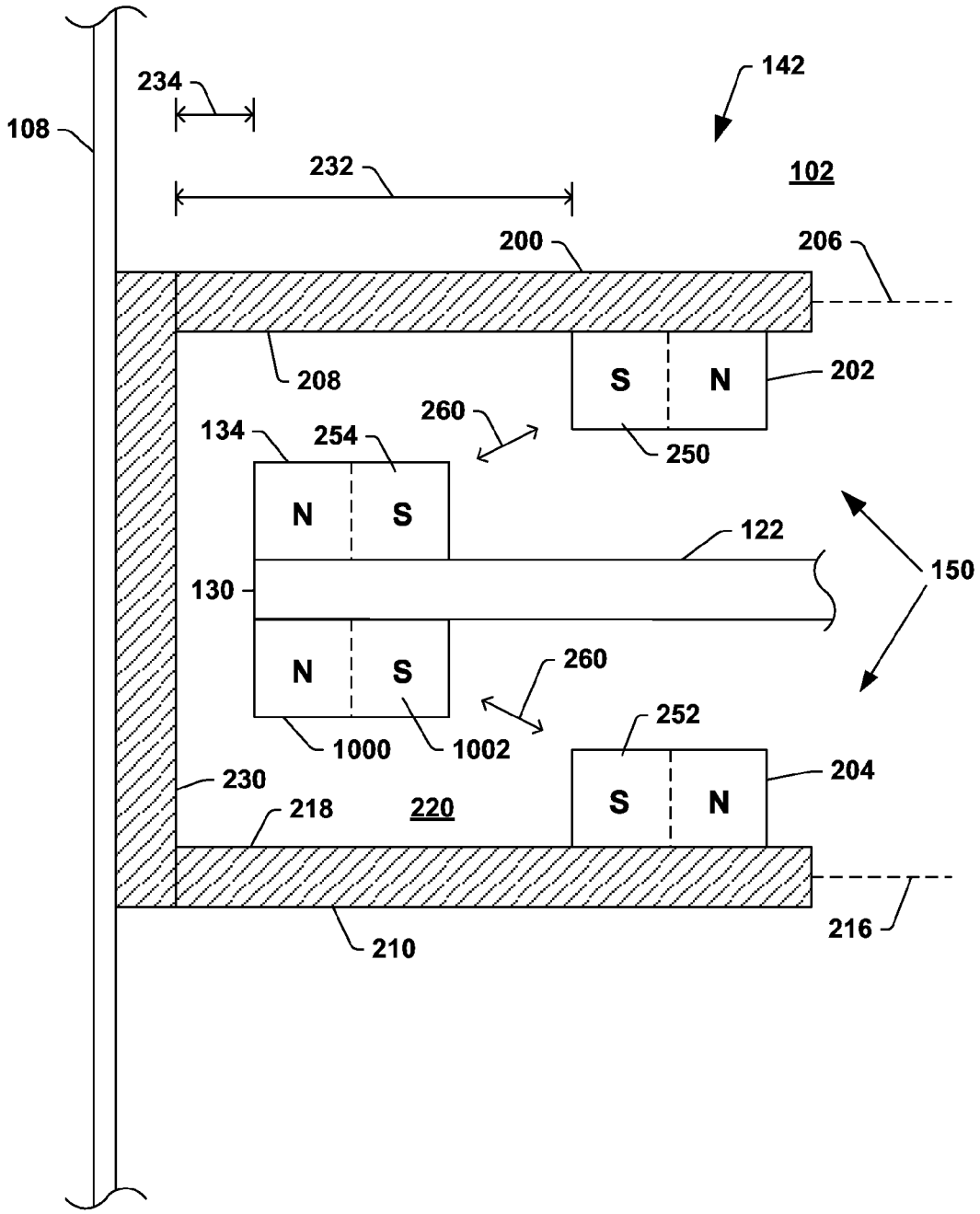
FIG. 10 illustrates a cross-sectional view of an example track portion of the door assembly.

Turning to FIG. 10, a third example of the first track portion 142 is illustrated. In this example, the curtain 122 can include a pair of first curtain magnetic devices. For example, the curtain 122 can include the first curtain magnetic device 134 on a first side of the curtain 122 and a first curtain magnetic device 1000 on an opposing second side of the curtain 122. Though not illustrated, the first curtain magnetic device 1000 can similarly be positioned at the second lateral edge 132 of the curtain 122 opposite the second curtain magnetic device 136. In these examples, the first curtain magnetic device 1000 can magnetically couple 260 with the second track magnetic device 204. That is, like poles (e.g., south pole 1002) of the first curtain magnetic device 1000 and the second curtain magnetic device 136 (e.g., south pole in this example) can be oriented to face each other. As such, by being magnetically coupled 260, the first curtain magnetic device 1000 is repelled from the second curtain magnetic device 136 such that the curtain 122 tends to remain within the channel 220.

It is to be appreciated that in some or all of the examples of FIGS. 1 to 10, the magnetic devices, the magnetic assemblies, etc. can include materials that have at least some degree of magnetism, but need not be limited to dipole magnets. Rather, in some examples, some or all of the magnetic devices, the magnetic assemblies, etc. may include metal materials (and/or materials that can be magnetized) that can magnetically couple with magnets, electromagnets, etc. For example, magnetic devices, the magnetic assemblies can include iron, cobalt, nickel materials, etc. As such, in some examples above, a magnetic device can attract or repel a metal material (e.g., iron, cobalt, nickel, etc.) so as to produce magnetic coupling as described above.

The words "example" and/or "exemplary" are used herein to mean serving as an example, instance, or illustration. Any aspect, design, etc. described herein as "example" and/or "exemplary" is not necessarily to be construed as advantageous over other aspects, designs, etc. Rather, use of these terms is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims may generally be construed to mean "one or more" unless specified otherwise or clear from context to be directed to a singular form. Also, at least one of A and B or the like generally means A or B or both A and B.

Although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated example implementations of the disclosure. Similarly, illustrated ordering(s) of acts is not meant to be limiting, such that different orderings comprising the same of different (e.g., numbers) of acts are intended to fall within the scope of the instant disclosure. In addition, while a particular feature of the disclosure may have been disclosed with respect to only one of several implementations, such feature may be combined with one or more other features of the other implementations as may be desired and advantageous for any given or particular application. Furthermore, to the extent that the terms "includes", "having", "has", "with", or variants thereof are used in either the detailed description or the claims, such terms are intended to be inclusive in a manner similar to the term "comprising."

What is claimed is:

1. A door assembly for covering an opening, the door assembly including:

a curtain supported at a first end of the opening, the curtain including a first lateral edge supporting at least one first curtain magnetic device; and a first track portion extending along a first opening side of the opening between the first end and an opposing second end, the first track portion including at least one first magnetic assembly, wherein the first curtain magnetic device is configured to magnetically couple with the first magnetic assembly of the first track portion such that the curtain is magnetically supported at the first lateral edge of the curtain, the first track portion including:

a first track wall supporting a first track magnetic device of the first magnetic assembly; and a second track wall spaced apart from the first track wall to define a channel between the first track wall and the second track wall, the second track wall supporting a second track magnetic device of the first magnetic assembly;

wherein the first lateral edge of the curtain extends between the first track magnetic device and the second track magnetic device into the channel such that the first curtain magnetic device is magnetically coupled with the first track magnetic device and the second track magnetic device.

2. The door assembly of claim 1, wherein the first track portion includes a third track wall attached to the first track wall and the second track wall.

3. The door assembly of claim 2, wherein the first track magnetic device and the second track magnetic device are spaced a first distance from the third track wall.

4. The door assembly of claim 3, wherein when the first lateral edge of the curtain extends between the first track magnetic device and the second track magnetic device into the channel, the first curtain magnetic device is spaced a second distance from the third track wall.

5. The door assembly of claim 4, wherein the first distance is greater than the second distance.

6. The door assembly of claim 1, wherein the first track wall extends along a first axis and the second track wall extends along a second axis, the first axis substantially parallel to the second axis.

7. The door assembly of claim 6, wherein the first axis and the second axis are substantially parallel to the curtain when the curtain extends between the first track magnetic device and the second track magnetic device into the channel.

8. The door assembly of claim 1, wherein the at least one first magnetic assembly includes a plurality of electromagnets.

9. The door assembly of claim 8, including a controller configured to selectively energize at least some of the electromagnets to induce an electromagnetic field in the electromagnets that are selectively energized.

10. The door assembly of claim 9, wherein when the controller selectively energizes at least some of the electromagnets, the selectively energized electromagnets are configured to magnetically couple with the at least one first curtain magnetic device of the curtain such that the curtain is movable along the first track portion.

11. The door assembly of claim 9, wherein the controller is configured to selectively energize at least some of the electromagnets by supplying current to the electromagnets in a forward direction and a reverse direction.

12. The door assembly of claim 1, wherein the curtain includes a second lateral edge, opposite the first lateral edge, supporting at least one second curtain magnetic device.

13. The door assembly of claim 12, including a second track portion extending along a second opening side of the opening between the first end and the second end, the second track portion including at least one second magnetic assembly.

14. The door assembly of claim 13, wherein the second curtain magnetic device is configured to magnetically couple with the second magnetic assembly of the second track portion such that the curtain is magnetically supported at the first lateral edge and the second lateral edge.

15. A door assembly for covering an opening, the door assembly including:

a curtain supported at a first end of the opening, the curtain including a first lateral edge supporting at least one first curtain magnetic device; and a first track portion extending along a first opening side of the opening between the first end and an opposing second end, the first track portion including:

a first track wall supporting a first track magnetic device;

a second track wall spaced apart from the first track wall, the second track wall supporting a second track magnetic device; and a third track wall attached to the first track wall and the second track wall to define a channel between the first track wall, the second track wall and the third track wall, wherein the first lateral edge of the curtain extends between the first track magnetic device and the second track magnetic device into the channel such that the first curtain magnetic device is magnetically coupled with the first track magnetic device and the second track magnetic device.

16. A door assembly for covering an opening, the door assembly including:

a winding assembly positioned at a first end of the opening, the winding assembly including:

a shaft; and a curtain that is configured to be windably supported on the shaft, wherein the curtain is movable between an unwound position, in which the curtain extends between the first end and an opposing second end of the opening, and a wound position, in which the curtain is windably supported on the shaft, the curtain including:

a first lateral edge supporting at least one first curtain magnetic device; and a second lateral edge, opposite the first lateral edge, supporting at least one second curtain magnetic device;

a track assembly including:

a first track portion extending along a first opening side of the opening between the first end and the second end, the first track portion including at least one first magnetic assembly, the first track portion including:

a first track wall supporting a first track magnetic device of the first magnetic assembly; and a second track wall spaced apart from the first track wall to define a channel between the first track wall and the second track wall, the second track wall supporting a second track magnetic device of the first magnetic assembly;

wherein the first lateral edge of the curtain extends between the first track magnetic device and the second track magnetic device into the channel such that the first curtain magnetic device is magnetically coupled with the first track magnetic device and the second track magnetic device; and a second track portion extending along a second opening side of the opening between the first end and the second end, the second track portion including at least one second magnetic assembly;

wherein when the curtain is in the unwound position, the first curtain magnetic device is configured to magnetically couple with the first magnetic assembly of the first track portion, the second curtain magnetic device is configured to magnetically couple with the second magnetic assembly of the second track portion such that the curtain is magnetically supported at the first lateral edge and the second lateral edge.

17. The door assembly of claim 16, wherein the opening is rectangular.

18. The door assembly of claim 16, wherein the first magnetic assembly includes at least one electromagnet.

* * * * *